US006541715B2

(12) United States Patent
Swanson

(10) Patent No.: US 6,541,715 B2
(45) Date of Patent: Apr. 1, 2003

(54) ALPHANUMERIC KEYBOARD FOR HAND-HELD ELECTRONIC DEVICES

(76) Inventor: Philip Swanson, 4 rue Delambre, 75014 Paris (FR)

( * ) Notice: Subject to any disclaimer, the term of this patent is extended or adjusted under 35 U.S.C. 154(b) by 0 days.

(21) Appl. No.: 09/863,276

(22) Filed: May 24, 2001

(65) Prior Publication Data

US 2002/0175057 A1 Nov. 28, 2002

(51) Int. Cl.[7] ..... H01H 9/25
(52) U.S. Cl. ..... 200/5 A; 200/5 R; 200/6 A
(58) Field of Search ..... 200/5 R, 5 A, 200/6 R, 4, 6 A, 17 R, 18; 341/22, 23, 20, 28, 34; 345/156, 168, 709.1; 364/709.08, 709.09, 709.12, 709.15

(56) References Cited

U.S. PATENT DOCUMENTS 4,029,915 A 6/1977 Ojima
5,528,235 A 6/1996 Lin
5,841,374 A 11/1998 Abraham

FOREIGN PATENT DOCUMENTS

| | | | |
|---|---|---|---|
| DE | 3446147 | 6/1986 | ..... G05G/1/02 |
| DE | 3702401 | 5/1987 | ..... G05G/1/02 |
| JP | 60231253 | 11/1985 | ..... G06F/15/20 |

*Primary Examiner*—Elvin Enad
*Assistant Examiner*—Lisa Klaus
(74) *Attorney, Agent, or Firm*—Young & Thompson

(57) ABSTRACT

An array of key members for inputting data or signals to an electronic device. Each key member has a convex outer surface including a plurality of outwardly converging facets. Each facet has corresponding alphanumerical characters or other indicia and is associated with a single switching element corresponding to alphanumerical characters or other indicia. Elements responsive to the application of pressure on each of the facets actuates a corresponding one of the switching elements. The array of key members comprises two or more aligned key members intersecting with two or more other aligned key members at at least one intersection. A finger base is located at the at least one intersection between adjacent key members and a single facet of the adjacent key members are located at each corner of the intersection.

19 Claims, 1 Drawing Sheet

ALPHANUMERIC KEYBOARD FOR HAND-HELD ELECTRONIC DEVICES

The present invention relates to alphanumeric keyboards for hand-held computers, word processors, mobile telephones and other electronic devices.

BACKGROUND OF THE INVENTION

The ability to decrease the size of portable computers, word processors, and similar devices has been limited to an important extent by the space needed for a workable keyboard. This problem is also relevant for the development of portable telephones with word processors and/or Internet access features. Traditional keyboard arrangements (e.g., QWERTY) can be inconvenient to use if they are made smaller than the standard size.

One space-saving solution for some portable telephones has been to use the regular number buttons to type or punch in letters that are commonly associated with those numbers on the telephone dial pad. The user presses a particular number key once, twice or more times to select one of the letters. An advantage of this solution is that it uses an association of letters with numbers and key locations that is familiar to potential users. The main problem is that users must make a larger number of key strokes than they otherwise would have to make on a standard typewriter keyboard.

Some portable telephones have employed a generally flat button that can be used for up to four functions, with each function corresponding to one edge of the button. The user selects the desired functions by pressing down near the appropriate edge. However, most telephones that have this feature typically provide only one such button, and its function usually is limited to scrolling or selecting menu options. Such buttons have not been used for typing alphanumeric characters. This may be because such buttons do not provide a significant space saving advantage over regular buttons, since the space needed for one flat, four-function button would be about the same as that needed for four regular buttons if the amount of surface area available for selecting each function were to be kept the same in both arrangements.

PRIOR ART

A solution that places several functions on one key without the need to make more than one keystroke per function is disclosed in U.S. Pat. No. 5,841,374. However, operation requires the use of all fingers, which means that the user must place the device on a flat surface to use it, and therefore may not hold it in his/her hands.

Ojima U.S. Pat. No. 4,029,915 discloses a keyboard consisting of a single row of resiliently biased keys, each adapted to be tilted in one of four directions by the user's finger tip for inputting information. The keys have a recessed top with a raised edge in a preferred embodiment or central projection sloping down to the respective edges of the keys in an alternative embodiment. The user's fingers are "based" on the keys and effect up, down, left and right movements. Simple keyboard operations require awkward finger movements.

Lin U.S. Pat. No. 5,528,235 discloses a keyboard array with rows of resiliently biased keys having five facets, four along the edges and the fifth at the center. The facets along the edges slope down to the fifth, recessed central facet. The user's fingers are based on the keys and effect up, down, left, right movements for inputting the desired signals. It has the same drawbacks as Ojima.

BRIEF SUMMARY OF THE INVENTION

This space saving alphanumeric keyboard attempts to reconcile the tradeoff between size and efficiency for small hand-held devices such as "palm-top" computers and mobile telephones, or even for non hand-held devices for which a small keyboard is desired. It does this by placing several characters on each key member, but without the need to make more than one keystroke per character. It employs a small number of multi-faceted key members, each of which may be easily and rapidly manipulated in a plurality of different directions, and makes use of spaces between clusters of keys as "bases" for the operator's thumbs or other fingers.

According to the invention, there is provided an array of key members for inputting data or signals to an electronic device. Each key member has a convex outer surface including a plurality of outwardly converging facets. Each facet has corresponding alphanumerical characters or other indicia and is associated with a single switching means corresponding to alphanumerical characters or other indicia. Means responsive to the application of pressure on each of said facets actuates a corresponding one of the switching means. The array of key members comprises two or more aligned key members intersecting with two or more other aligned key members at at least one intersection. A finger base is located at the at least one intersection between adjacent key members and a single facet of the adjacent key members are located at each corner of the intersection.

Such a key member array advantageously provides finger bases at intersections between alignments of key members with direct access to the facets at the intersection, thereby improving ease of operation and overall ergonomy.

The features and advantages of the invention will become more apparent from the following description given by way of example with reference to the accompanying drawings.

DETAILED DESCRIPTION OF THE PREFERRED EMBODIMENTS

Figure 1:
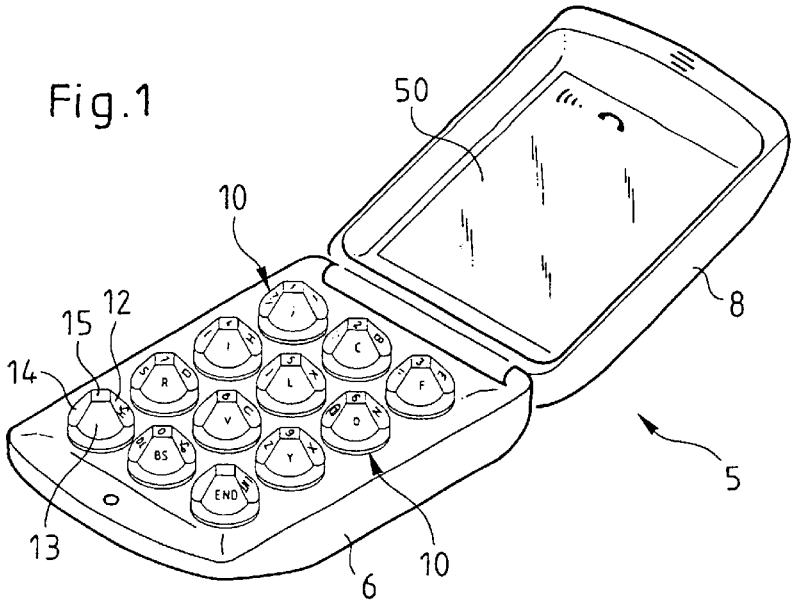
FIG. 1 is a perspective view and illustrates a hand held computer or cellular phone incorporating an array of key members according to a preferred embodiment of the invention.
Figure 2:
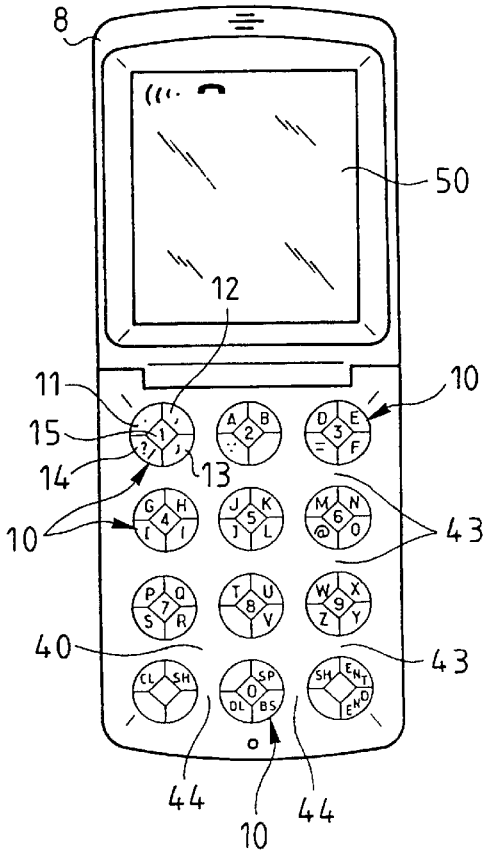
FIG. 2 is a top view of the hand held computer or cellular phone according to the preferred embodiment of the invention.

As illustrated by FIGS. 1 and 2, an alphanumeric keyboard 2 comprising an array 3 of multi-functional key members 10 is incorporated into a hand held computer or a cellular phone 5 including a housing 6, and a hinge cover 8 adapted to cover the keyboard in the closed position and to serve as a display screen 50 in the open position.

Each key member 10 has a convex faceted upper surface and is generally of conical or pyramidal shape, with preferably four sloping lateral faces or facets 11, 12, 13, 14 that converge upwardly and a top facet 15. Planar facets are preferred, but alternatively they may be curved, e.g., concave.

The key members 10 are designed to be pushed from the side or from the top by the user's thumbs or other fingers and are not intended to be gripped between fingers like a toggle switch.

An indication of the alphanumeric character or other keyboard function indicia performed by pressing the facet is affixed to each facet 11, 12, 13, 14, 15 of key member 10. To key in a particular alphanumeric character or other indicia, the user pushes the appropriate facet of the appropriate key member.

Figure 3:
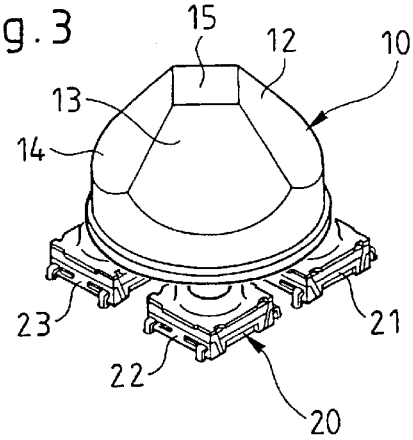
FIG. 3 is an enlarged perspective view of a preferred embodiment of one of the key members for the array illustrated in FIGS. 1 and 2.
Figure 4:
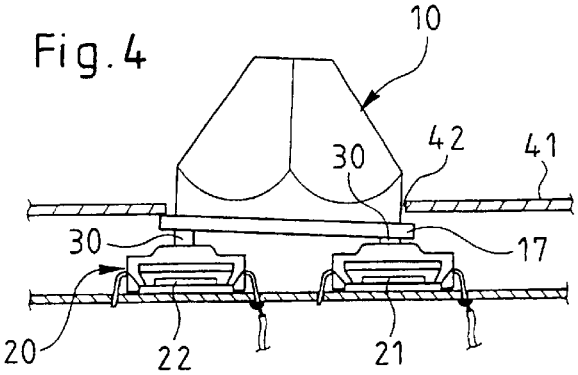
FIG. 4 is an enlarged part sectional view of the key member illustrated in FIG. 3.

Each key member 10 is biased into a neutral upright position as shown in FIG. 3 and is rockably mounted for movement in four diagonal directions, commonly referred to as "Northwest", "Southwest", "Northeast" and "Southeast", to temporary, unstable positions, such as the one shown in FIG. 4.

Below each of the key members 10 is provided a plurality of switching means 20 having a corresponding plurality of upstanding switch actuators 30. Each of the switching means of a key member 10 comprises spring biasing means (not shown) which together urge the key member outwardly relative to the keyboard plate 41 to a stable, non-operating position. The key member 10 preferably has a peripheral flange 17 extending transversely from its bottom side which is larger than the opening 42 in the keyboard plate through which the key member protrudes to retain the key member in place relative to the keyboard plate.

Pushing against a facet, for example facet 14 as shown in FIG. 2 and FIG. 3 will depress a corresponding switch actuator 30 of switch 21 keyboard located below the key member 10 and opposite the facet 14, whereby the switch 21 produces a signal corresponding to the selected alphanumeric character or indicia, here a period question mark (?). After pressure on the facet is released, the key member 10 returns to its normal vertical position, and the circuit returns to its normal standby condition.

In the illustrated embodiment, each key member 10 is associated with four microswitches with respective actuators which are mounted on a base plate 42 below the key member. The lateral faces or facets 11, 12, 13, 14 of each key member 10 are oriented at 450 to the grid pattern defined by the switch actuators. Thus, by pressing lateral facet 11, the microswitch 22, which is located opposite from the lateral facet 11, is actuated. By pressing lateral face or facet 12, generally normal to its face, the key member is rocked so as to actuate the microswitch 23. By pressing the facet 13, the key member 10 is rocked to actuate the microswitch 24. Finally, by pressing lateral face 14, in a direction normal thereto, the key member is tilted in order to actuate microswitch 21.

Also, by depressing the top facet 15 of any key member, two or more of the switching means 21–24 are concurrently actuated though not necessarily simultaneously. By programming a microprocessor (not shown) connected to the switching means to select a keyboard function when two or more of the microswitches associated with a particular key member are concurrently actuated, the operator may select that function by pressing the top face or facet 15 of the key member. For example, pressing down on the top facet 15 bearing numeral "2" would cause two or more microswitches associated with that key member to produce respective signals and the combination of two or more such signals would be detected by the microprocessor as numeral "2". Other methods to select a function by pressing the top facet may be adopted, e.g., such as the buttons on the top of toggle switches described in European patent application No. 0.083.421, published Jul. 13, 1983, or in French patent application No. 90 04974, published Oct. 18, 1991.

The key members 10 are designed to be disposed in an array, such that "bases" 40, for thumbs or other fingers are defined between key members, e.g., at the intersection 40 of the row lanes 43 and column lanes 44 of spaces between the respective key members 10. In the illustrated embodiment each finger base or intersection 40 is surrounded by four single lateral facets of four adjacent key members 10 located diagonally around the intersection. Four key members at an intersection 40 respectively bear the numerals "1", "2", "4" and "5" on their top facets 15, while the respective lateral facets at the intersection between these key members are the lateral facet 13 of the key member in the "Northwest" corner of the intersection or base bearing the semi-colon ";", the lateral facet 14 of the key member on the "Northeast" corner of the intersection bearing the percent symbol "%", the lateral facet 11 of the key member in the "Southeast" corner of the intersection bearing the letter "J" and the lateral facet 12 of the key member in the "Southwest" corner of the intersection bearing the letter "H". The illustrated arrangement of alphanumeric characters and other indicia is given by way of example. Other characters or indicia could be affixed to the facets. The key members 10 are oriented so that a single lateral facet faces a lateral facet of up to three other key members 10 at an intersection.

In the preferred embodiment, the lateral facets are disposed diagonally to the intersections, e.g. at 45° to the row lanes 43 and column lanes 44. The space comprising the intersection and the four lateral facets (all of which converge outwardly away from the intersection of the four adjoining key members) defines an ergonomic space for a thumb or another finger. This arrangement allows the key members to be arranged relative to one another in such a way that the space between them is wider at the top of the key members than at the bottom (i.e., near the plate 41 of the keyboard), thus allowing the key members to be clustered closely together, while leaving enough room for a thumb or another finger to be placed in the intersection surrounded by lateral facets 11, 12, 13, 14 of different key members.

The shape of the key members also allows all facets of all key members to be visible simultaneously from the front, as shown in FIG. 2, allowing the operator to see the printed matter affixed to the facets indicating the alphanumeric characters, or other indicia corresponding to symbols or keyboard functions.

In the preferred arrangement as illustrated, the keyboard array comprises a total of twelve key members 10 in four rows of three key members each, similar to the arrangement of buttons on a standard push button or Touch-Tone telephone keypad.

According to a preferred arrangement, the top face or facet 15 of each key top member 10 is assigned the same number as the corresponding push buttons on a standard telephone keypad. Thus, the top facets of the first row of key members are assigned the numbers "1", "2" and "3"; the second row of key members 10 are assigned the numbers "4", "5" and "6"; the third row of key members 10 are assigned "7", "8" and "9", and the middle key member 10 of the fourth row is assigned "0", as illustrated in FIG. 2.

The lateral facets of the key members 10 may be assigned the letters which are commonly associated with particular numbers on standard telephone keypads. For example, the operating key member whose top facet bears numeral "2" has three of its four side faces or facets bearing letters "A", "B" and "C", respectively. Key members 10 whose top facets bear the numbers "4", "5", "6", "7", "8" and "9" also have three or four lateral facets bearing letters of the alphabet (see also FIG. 2).

Preferably, the keyboard according to the present invention is operated with two thumbs. The preferred "home" base for the left thumb would be at the intersection 40 of the four key members whose top facets bear numerals "4", "5", "7", and "8" and the preferred home base for the right thumb would be at the intersection of the four key members whose top facets bear the numerals "5", "6", "8" and "9". (See FIG. 2).

With two such thumb home bases, the user would have immediate access to a total of eight different letters or keyboard functions, in this example those corresponding to facets bearing symbols "I", "]", "T", "Q", and "L", "@", "W" and "U". Movement of either thumb above or below the home base to an "away" base brings the user's thumbs to four more intersections, each surrounded by four facets, for a total of sixteen additional characters and/or keyboard functions. Twenty four additional characters and/or keyboard functions would be available on the key faces or facets along the outside edges of the array, in addition to the twelve top facets, for a total of sixty primary characters and/or functions in all.

One or more "shift" keys, such as that on facet "SH", as illustrated, may increase (e.g., double or triple) the total characters and/or keyboard functions available. For this purpose, key member facets could bear two or three different indicia, preferably in different colors and located one above the other. Indicia could also be placed at the intersections next to relevant facets.

According to an alternative array design, the characters and keyboard functions are assigned in accordance with their frequency of use, e.g., the most frequently used letters or characters would be assigned to facets that are most convenient to reach from the home bases. Since character frequency differs according to language, multiple standards could be adopted. By employing appropriate keyboard overlays (not shown), the user could switch from one standard to another.

According to an alternative embodiment (not shown), the key members are mounted in a fixed position and are not moved by the application of force applied to the respective facets. In this embodiment, each of the facets is provided with a pressure sensitive means, such as piezo-electric sensor for generating signals in response to the application of force to the respective facets. The detection force would be moderate but sufficiently high to avoid inadvertent generation of signals by mere brushing contact with facets.

In another variant (not shown), each key member has a truncated conical or pyramidal frame with spaces receiving individual push buttons, wherein the pressing of one button does not change the position of the key member.

According to another illustrated feature, additional push buttons 10A are located in lanes or rows between key members, two of which are illustrated, and also between one or more key members and the perimeter around the array, only one of which is illustrated.

The illustrated embodiment shows the keyboard array incorporated in a hand held computer or cell phone. For one skilled in the art, it will readily be apparent that such an array is suitable for use in a variety of hand held electronic devices.

It would be appreciated that these and other modifications and variants of the novel key member and keyboard may be adopted without departing from the spirit and scope of the invention defined by the appended claims.

I claim:

1. An array of key members for inputting data or signals to an electronic device, each of said key members having a convex outer surface including a plurality of outwardly converging facets, each of said facets having corresponding alphanumerical characters or other indicia, each of said facets being associated with a single switching means corresponding to alphanumerical characters or other indicia, means responsive to the application of pressure on each of said facets for actuating a corresponding one of said switching means, said array of key members comprising two or more aligned key members intersecting with two or more other aligned key members at at least one intersection, a finger base being located at said at least one intersection between adjacent key members and a single said facet of said adjacent key members located at each corner of said at least one intersection.

2. An array of key members according to claim 1, wherein said two or more aligned key members and said two or more other aligned key members are diagonally aligned.

3. An array of key members according to claim 2, wherein pairs of said single facets at said at least one intersection are oriented diagonally relative to said at least one intersection.

4. An array of key members according to claim 1, further comprising a top facet located at a converging end of said plurality of outwardly converging facets.

5. An array of key members according to claim 4, wherein said top facet of each of said key members corresponds to at least two of said switching means of said key member, whereby the alphanumerical character or other indicia corresponding to said top facet is selected by concurrent operation of said at least two switching means.

6. An array of key members according to claim 1, wherein said two or more aligned key members define between each other a row and said two or more other aligned key members define between each other a column, a row lane and a column lane between said key members intersecting at said at least one intersection.

7. An array of key members according to claim 5, further comprising additional push buttons having a generally flat outer surface are located in one or more of said lanes between key members, each of said push buttons having corresponding switching means for selecting another alphanumeric character or other indicia.

8. An array of key members according to claim 7, further comprising at least one additional push button located peripherally of the array.

9. An array of key members according to claim 1, wherein said plurality of outwardly converging facets consist of four facets, said convex outer surface being divided into quadrants.

10. An array of key members according to claim 1, wherein each of said key members is mounted for tilting movement in response to depressing one of said facets of said key members, switching means comprising an actuator cooperable with a lower surface of said key member, each of said facets being operatively associated with an actuator located beneath another said facet disposed diagonally opposite thereto.

11. An array of key members according to claim 1, wherein each said key member is biased to a neutral rest position by spring means associated with each of said switching means of said key member.

12. An array of key members according to claim 8, wherein each of said spring means is responsive to depressing a facet located diagonally opposite said spring means.

13. An array of key members according to claim 1, wherein said key members are immobile, said facets of said key members including pressure sensitive means for generating signals.

14. An array of key members according to claim 1, wherein each of said switching means is responsive to depressing said facet generally in alignment with said switching means.

15. An array of key members according to claim 1, wherein said key members comprise a stationary frame defining edges between said plurality of outwardly converging facets, each of said facets comprising a depressible push button for controlling corresponding switching means.

16. An array of key members according to claim 1, wherein said array of key members comprises at least four rows of three key members, said top facets of a first row respectively bear digits 1, 2 and 3, the top facets of a second row respectively bear digits 4, 5 and 6, the top facets of a third row respectively bear digits 7, 8 and 9, and one of said top facets of a fourth row bear digit 0.

17. An array of key members according to claim 1, further comprising a keyboard plate having apertures for receiving said plurality of key members, whereby said outwardly converging facets of said key members extend outwardly beyond said keyboard plate.

18. An array of key members according to claim 17, wherein each said key member has a peripheral flange extending from a diverging end of said outwardly converging facets, said peripheral flange being located beneath and being concealed by said keyboard plate.

19. An array of key members according to claim 18, wherein two or more said peripheral flanges are integral with one another.

* * * * *